United States Patent [19]

Martin

[11] Patent Number: 4,817,260

[45] Date of Patent: Apr. 4, 1989

[54] METHOD AND APPARATUS FOR DEBANDING MAIL BUNDLES

[76] Inventor: Gordon S. Martin, 12265 SW. 72nd Ave., Tigard, Oreg. 97223

[21] Appl. No.: 127,802

[22] Filed: Dec. 2, 1987

[51] Int. Cl.[4] ..... B23P 19/04

[52] U.S. Cl. ..... 29/426.6; 29/235; 29/426.3; 29/720; 53/381 A; 53/492; 414/411

[58] Field of Search ..... 29/235, 426.3, 426.6, 29/450, 709, 720; 53/381 A, 492; 414/411, 412

[56] References Cited

U.S. PATENT DOCUMENTS

| | | | |
|---|---|---|---|
| 2,887,767 | 5/1959 | Mott | 29/235 X |
| 4,404,723 | 9/1983 | Ohba et al. | 29/33.52 |
| 4,553,312 | 11/1985 | Mitzel et al. | 29/564.3 |
| 4,660,818 | 4/1987 | Conner et al. | 29/426.3 X |

FOREIGN PATENT DOCUMENTS

| | | | |
|---|---|---|---|
| 240289 | 10/1987 | European Pat. Off. | 414/411 |

*Primary Examiner*—Timothy V. Eley
*Assistant Examiner*—Andrew E. Rawlins
*Attorney, Agent, or Firm*—Klarquist, Sparkman, Campbell, Leigh & Whinston

[57] ABSTRACT

Rubber bands are removed from a bundle of envelopes by clamping a portion of the bundle to hold the bundle in a fixed position, opening a gap between two envelopes of the bundle, and inserting a pendulum-like band engaging blade into the gap. By swinging and retracting the blade, longitudinal rubber bands are pulled off the bundle. And, by pulling the bundle from the reinserted blade, lateral rubber bands are stripped off the bundle.

18 Claims, 5 Drawing Sheets

METHOD AND APPARATUS FOR DEBANDING MAIL BUNDLES

BACKGROUND OF THE INVENTION

This invention relates to devices for removing elastomeric bands from bundles of objects, particularly bundles of postal envelopes.

Sheet-like objects, particularly envelopes, are frequently secured in bundles by elastomeric "rubber bands". Rubber bands are easier to apply manually than bands made of a non-elastic material such as paper. Rubber bands can stretch to accommodate bundles of various shapes and sizes. And, the rubber bands can be re-used after the bundle is broken.

Postal services process large quantities of mail bundles secured by rubber bands. By regulation, certain mailers must provide mail to the U.S. Postal Service in banded bundles to aid automated handling. Bundles are to be secured with rubber bands of certain specified characteristics. Even the positioning of the bands is specified by regulation, although not every mailer conforms to the specifications. Presently, prior to sorting by the Postal Service, the rubber bands are manually removed. The removed bands are collected and returned to the mailers for reuse.

Manually removing the rubber bands is a labor-intensive and tedious job. It would be preferable to remove the bands by machine. But, heretofore, there has been no automated mechanism to nondestructively remove rubber bands from bundles that may vary in size and shape.

Prior devices, such as those shown in U.S. Pat. Nos. 4,404,723 of Ohba et al. and 4,553,312 of Mitzel et al. are used for removing paper bands from bundles of currency. Such devices, however, will only work with very uniformly sized and shaped bundles, such as bundles of currency. Thus, the prior devices are not suitable for debanding mail bundles which are not inherently uniform in size, shape, or banding pattern.

SUMMARY OF THE INVENTION

The present invention is an apparatus and method for nondestructively removing elastomeric bands that encircle bundles of mail. The bundles are carried to a work station on a conveyor. Apparatus at the work station includes clamps for grasping a bundle and a blade-like member which is inserted into the bundle and then moved in such a manner as to grasp a lengthwise rubber band and pull it free. Girthwise bands are removed by pulling the bundle away from the blade while the blade is positioned to retain any girthwise bands. Using this apparatus and method, both lengthwise and girthwise bands are removed, regardless of the order in which the bands were placed on the bundle.

The blade is operated by one or more actuators, preferably air cylinders, which are directed by a control mechanism. Depending on the nature of the bundles to be sorted, a spreader mechanism can be used to open and maintain a gap between two envelopes of the bundle to ease insertion of the blade. After the rubber bands are removed at the work station, the bundles can be automatically deposited in a tray of the type used to feed automated sorting machines.

The apparatus and method of the present invention are designed to avoid damaging the bundled envelopes. In particular, the spreader mechanism is designed to protect against inadvertent puncture of "window" envelopes by the debanding blade or by other elements of the apparatus.

It is thus an object of the invention to automatically remove rubber bands which encircle bundles of sheet-like objects, particularly letter bundles.

A further object is to provide a mechanism for removing both lengthwise and girthwise rubber bands, regardless of the order in which the bands are applied or the position of the bands on the bundle.

A particular object is to remove such rubber bands nondestructively and without damage to envelopes.

Another object is to automatically insert mail bundles into a sorting tray after rubber bands have been automatically removed.

These and other features, advantages and object of the invention will be best understood with reference to the detailed description and drawings.

DETAILED DESCRIPTION

Figures 1, 6:
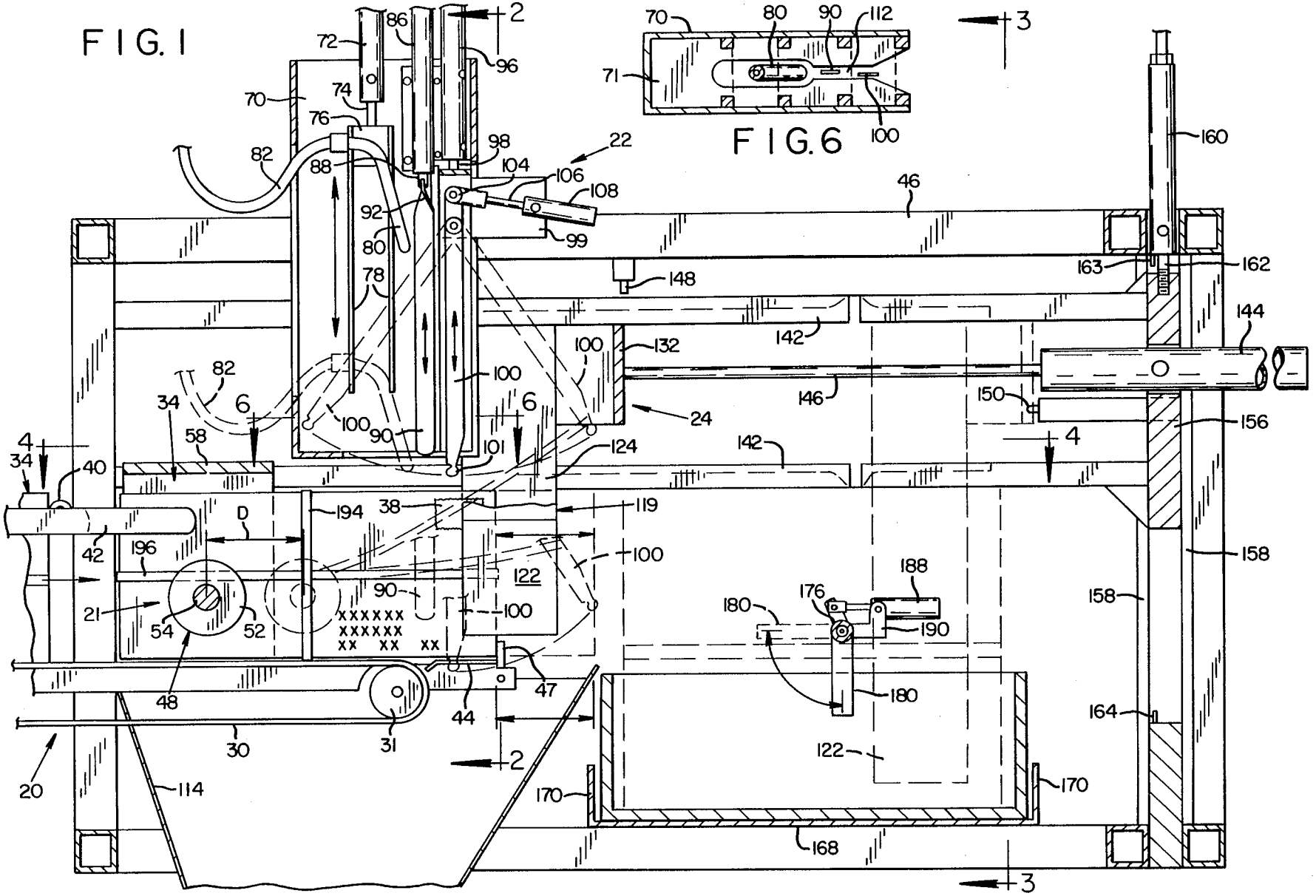
FIG. 1 is a vertical sectional view of an apparatus according to the present invention for removing rubber bands from bundles of envelopes.
FIG. 6 is a partial sectional view taken along line 6—6 of FIG. 1.
Figure 2:
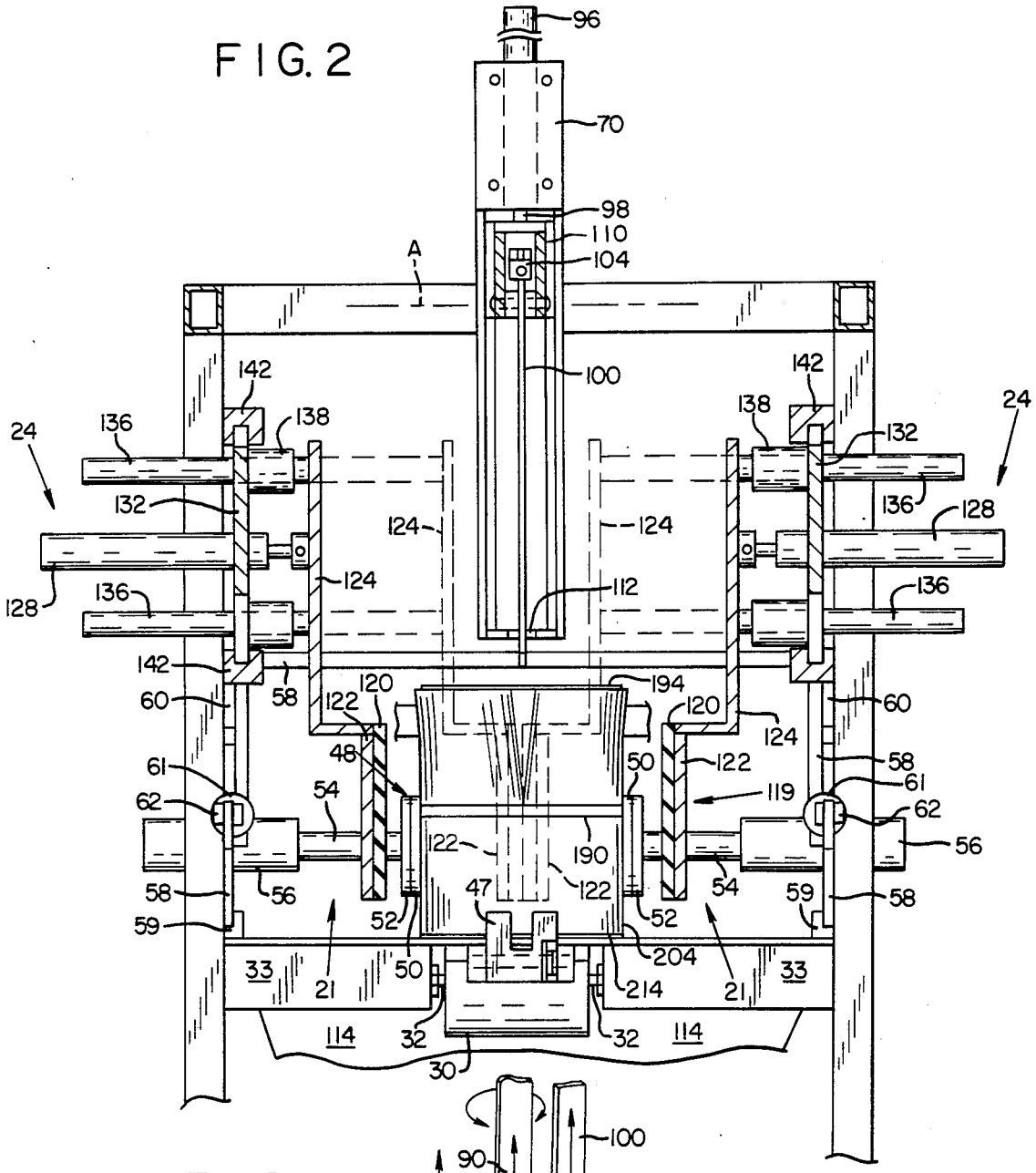
FIG. 2 is a sectional view taken along line 2—2 of FIG. 1.

A conveyor mechanism 20 carries a bundle of mail, encircled by rubber bands, to a work station where a positioning mechanism 21 clamps onto the bundle. While secured by the positioning mechanism at the work station, a debanding mechanism 22 is used to remove the bands. A transport mechanism 24 works with the debanding mechanism and carries the bundle, after it has been debanded, and positions it into a sorting tray. The conveyor mechanism 20 includes an endless conveyor belt 30 which extends around a drive roller 31 and an idler roll (not shown). The drive roller 31 is connected by a drive shaft 32 to a drive motor or drive gear mechanism 33.

Mail bundles 34 are deposited on the belt with longitudinal edges 36 of the envelopes seated on the belt 30. For convenience in later handling, each bundle is placed on the conveyor in the same orientation. The orientation is identified by the location of a stamp 38. A stamp sensor 40, such as a detector sensitive to conductive postage stamp ink, may be positioned alongside the conveyor to verify the orientation of the bundle and reject any bundle not properly oriented. By regulation, all the envelopes within a bundle have the same orientation.

Along the conveyor belt 30 are one or more sets of mail support brushes or fingers 42. The brushes, which are preferably made of spring steel, are positioned to vertically align and support passing bundles and to center the bundles over the belt 30.

The conveyor mechanism 20 carries the bundles to a work station where the bundle is supported by a platform 44. The positioning mechanism 21 and the debanding mechanism 22, which in the illustrated embodiment are supported by a frame 46, are located at the work station. A limit sensor 47 signals when a bundle arrives in position on the platform 44 for debanding. The illustrated sensor is a switch with a hinged, spring-loaded throw lever positioned to be pushed aside by bundles traveling along the conveyor.

The positioning mechanism 21 is provided to position the workpiece bundle in relation to the debanding mechanism 22 and to position the bundle for receipt by the transport mechanism 24 after all lengthwise rubber bands are removed. This positioning mechanism 21 includes a clamp assembly 48 which consists of a pair of opposed friction pads 50 mounted on plates 52 on the distal ends of actuator shafts 54. The shafts 54 extend from actuators 56. For speed of operation and cleanliness, the actuators 56 and all other actuators mentioned herein are preferably air cylinders. The actuators 56 are mounted on a carriage 58 for movement, along a path defined by channel members 59 and spacer bars 60, parallel to the upper surface of the belt 30. The carriage 58 is moved by actuators 61 which are pivotally secured at one end to the frame 46 by means of connection brackets 62. Actuator shafts 64 are pivotally mounted to the carriage 58 by means of connection brackets 66.

The debanding mechanism 22 is contained within a housing 70 which is mounted to the frame 46 and has a floor 71. Three actuators are mounted to the housing. The first actuator 72 has an extendible shaft 74 connected to a nozzle carriage 76 mounted for vertical movement along parallel rails 78. The carriage 76 mounts an air nozzle 80, connected by a flexible hose 82 to a source of pressurized air (not shown). The second actuator 86 has an extendible and rotatable shaft 88 attached to a spreader blade 90 which has a helical portion 92 near its connection with the shaft 88. A third actuator 96 has an extendible shaft 98 connected to a carriage 99. The carriage 99 mounts a rubber band engaging blade 100, which is mounted for pivotal, pendulum-like motion around an axis A. The blade 100 has a detent 101 or other hook-like element to retain rubber bands. Blade 100 is also pivotally mounted by means of a connector 104 to the shaft 106 of an actuator 108, which in turn is pivotally mounted to the carriage 99. The carriage 99 extends through an opening 110 in a wall of the housing 70. When extended during operation, each of the nozzle 80, spreader blade 90 and band engaging blade 100 extend through a slot 112 defined by the floor 71 of the housing 70, as shown in FIG. 6.

A chute 114 is provided, below the debanding mechanism 22 and conveyor belt 30, to collect rubber bands after they are removed from the bundles.

The transport mechanism 24 holds and pulls the bundle 34 past the blade 100 during a portion of the debanding operation and moves the debanded mail bundles into a sorting tray 116, which has a leading wall 118. This transport mechanism has a clamping mechanism 119, including opposed pairs of friction pads 120 for engaging opposite faces of a bundle 34. The friction pads 120 are supported by plates 122 which are suspended from mounting brackets 124. Brackets 124 are horizontally movable by means of actuators 128 which are connected to the brackets 124 by shafts 130. The actuators 128 are mounted on a carriage 132. Stabilizing shafts 136 are mounted on the mounting brackets 124 and positioned to extend through sleeves 138 on the carriage 132.

The carriage 132 is also mounted for horizontal sliding movement between opposed track guides formed by channel members 142. Horizontal motion of the carriage 132 is achieved by means of an actuator 144 pivotally mounted to the frame 46, a shaft 146 connects the piston of the actuator 144 and the carriage 132. Sensors 148, 150, which may be micro switches, photo cells or equivalent devices, are mounted on the frame 46 to detect the positions of the carriage 132 when the shaft 146 is fully extended or fully retracted.

The actuator 144 is pivotally mounted to a carriage member 156. The carriage 156 is mounted for vertical movement between track guides formed by opposed channel members 158. An actuator 160, mounted to the frame 46, has a shaft 162 which extends between the actuator piston and the carriage 156. Sensors 163, 164 detect and signal the location of the carriage 156 when it is fully raised or lowered.

Figures 4, 5:
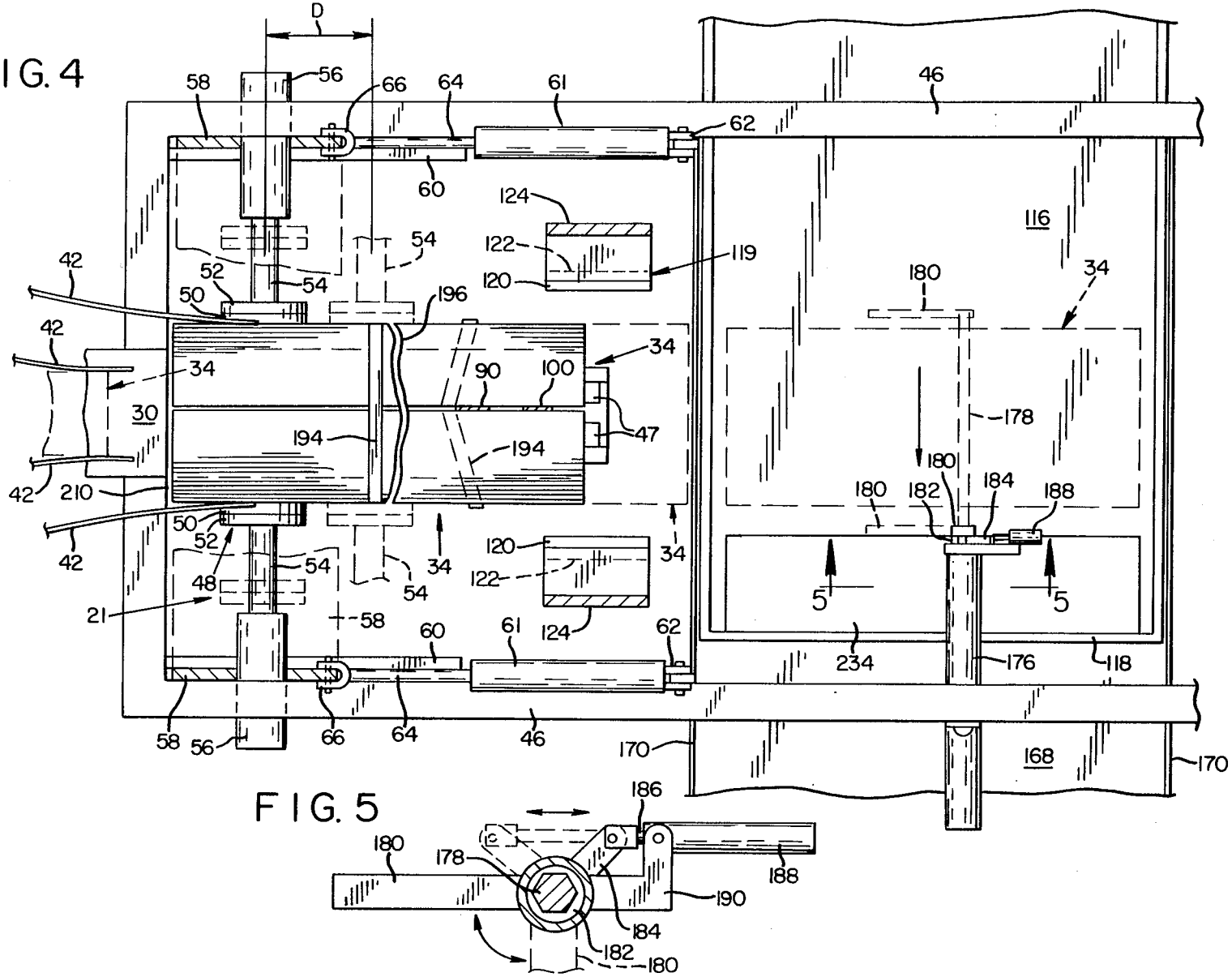
FIG. 4 is a sectional view taken along line 4—4 of FIG. 1.
FIG. 5 is a partial sectional view taken along line 5—5 of FIG. 4.
Figure 8:
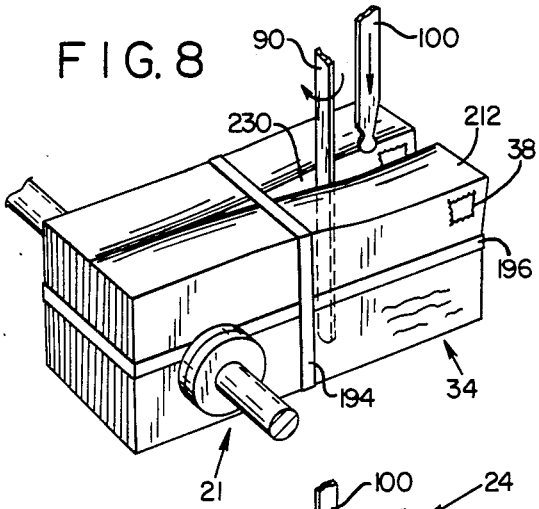
FIG. 8 is a perspective, schematic view of the bundle shown in FIG. 7 with a spreader blade inserted.
Figure 9:
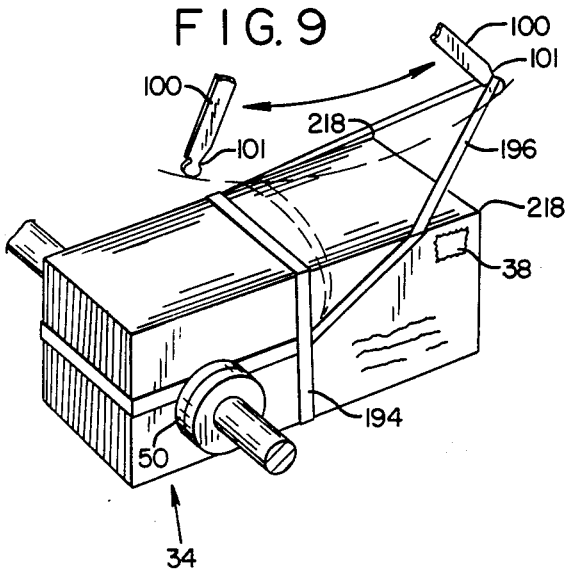
FIG. 9 is a perspective, schematic view of the bundle shown in FIG. 7 with a blade having moved a lengthwise rubber band away from one end of the bundle.
Figure 10:
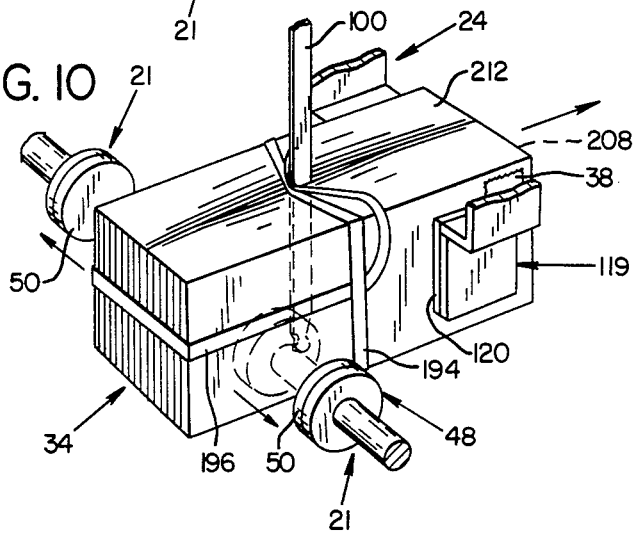
FIG. 10 is a perspective, schematic view of the bundle shown in FIG. 7 with a band engaging blade inserted after a lengthwise rubber band has been released.
Figure 11:
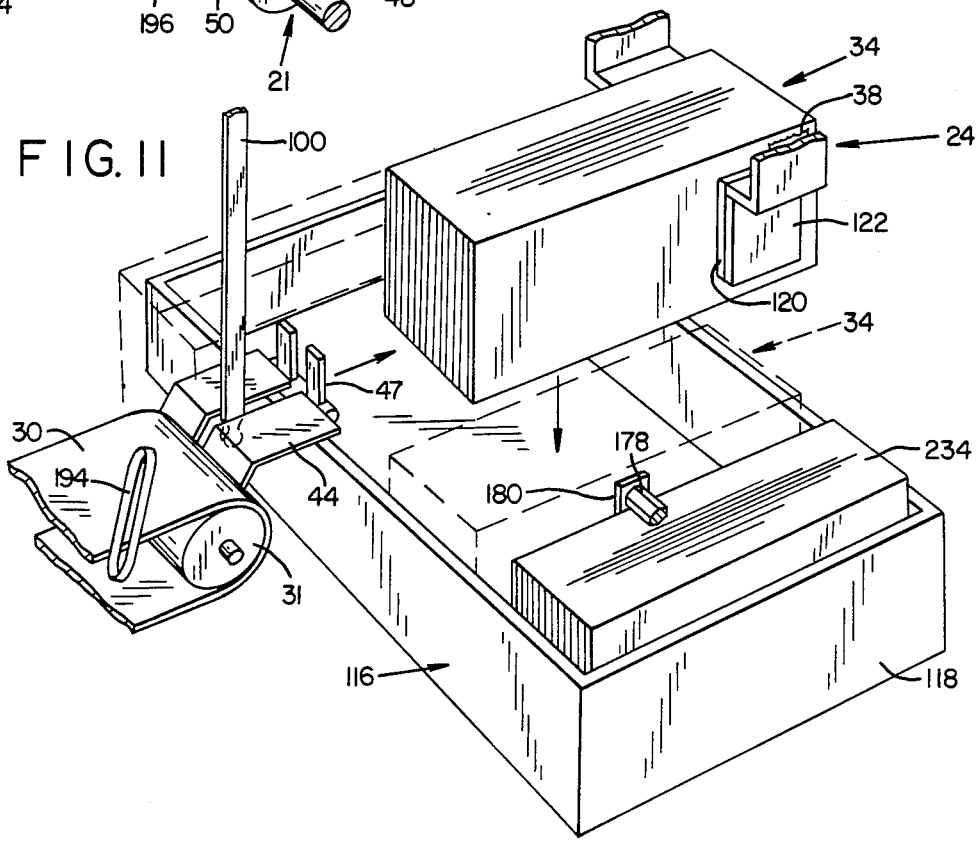
FIG. 11 is a perspective, schematic view of the bundle of FIG. 7, after all rubber bands have been removed, and of a mechanism for positioning the bundle in a sorting tray.

Sorting trays 116 are provided on a pathway at the end of the conveyor mechanism. In the illustrated embodiment, a channel is defined by a support surface 168, which may consist of a series of rollers (not shown), and guide rails 170. A mechanism is provided for supporting debanded envelopes after they have been deposited in a tray 116 and for advancing the tray as it fills. This apparatus includes an actuator 176 mounted to the frame 46, with a shaft 178 which extends horizontally, transversely to the belt 30. A support arm 180 extends radially from the free end of the shaft 178. The shaft 178 is of a hexagonal or other non-circular cross section, and extends through a mating collar 182, as shown in FIG. 5. The collar 182 is constructed such that the shaft 178 can slide axially through the collar, but is keyed to the collar so that rotation of the collar causes rotation of the shaft. Extending radially from the collar 182 is a lever arm 184, which is pivotally mounted to the shaft 186 of an actuator 188. The actuator 188 is mounted to the body of the actuator 176 and thereby to the frame 46. This is accomplished using a bracket 190, which is connected to the body of the actuator 176 and pivotally connected to the actuator 188 so that operation of the actuator 188 causes the shaft 178 to rotate.

Operation of the invention is best understood with reference to FIGS. 7–11. Bundles of envelopes 34 are placed on the conveyor belt 30 by an operator or automated mechanism. Bundles in accord with postal regulations will be encircled and girded by one lateral or girthwise rubber band 194 and, depending on the size of the bundle, by one longitudinal or lengthwise rubber band 196. In practice, bundles will vary in size and some will have multiple girthwise rubber bands. The bands will not necessarily be centered. Such irregularities do not affect operation of the present invention.

Each bundle includes a front face 202 showing an address and a stamp, and a rear face 204 showing the reverse side of an envelope, all the envelopes in the stack being uniformly faced. The edges of the envelopes define edge faces of the bundle, including a leading edge face 208, a trailing edge face 210, a top edge face 212 and a bottom edge face 214. The end faces, including leading and trailing edge faces 208, 210, are defined by lateral edges of the envelopes, and the top and bottom edge faces 212, 214 are defined by the longitudinal edges 36 of the envelopes in the bundle. The edge faces intersect at leading top corners 218, leading bottom corners 220, trailing top corners 222, and trailing bottom corners 224.

A bundle is carried by the belt 30 between the brushes 42 until it engages the limit switch 47 (FIG. 1). Upon receipt of the signal from the sensor 47, the actuators 56 operate to extend shafts 54 so that the friction pads 50 engage front and rear faces 202, 204 of the bundle to temporarily prevent any bundle movement. And, the actuator 72 extends shaft 74 to position the nozzle 80 above the top edge face 212 of the bundle.

Figure 7:
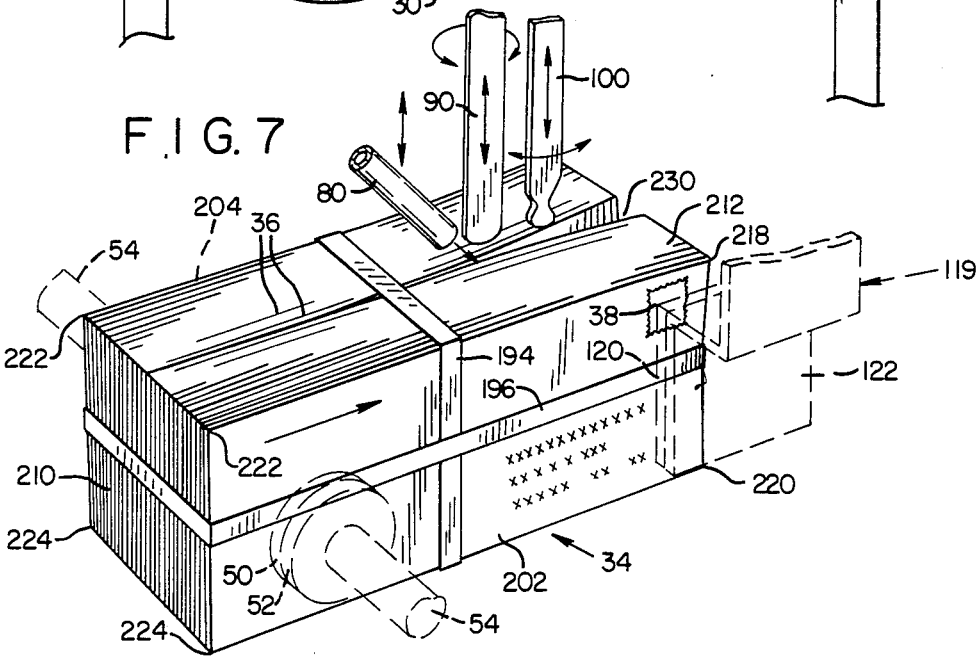
FIG. 7 is a perspective, schematic view of a bundle of mail positioned at the debanding station of the apparatus shown in FIG. 1.

When the nozzle 80 is in position, a valve (not shown) is opened to the air supply so that a jet of air issues from the nozzle 80. At the center of the jet, the upper longitudinal edges of two adjacent envelopes are forced apart at the top edge face 212 of the bundle to create a gap 230 as shown in FIG. 7.

A second actuator 86 then operates to extend the shaft 88 so that the separator blade 90 extends into the gap 230. As the helical portion 92 of the blade passes through the slot 112, the helical portion 92 acts as a cam which causes rotation of the blade 90 to the position shown in FIG. 8. Rotation of the blade widens and maintains the gap 230.

Next, the actuator 96 operates to extend the band-engaging blade 100 into the gap 230. The actuator 108 then extends shaft 106 to swing the blade 100 to the right-hand position shown in FIG. 9. As the blade 100 swings, the third actuator 96 retracts the shaft 98 to raise the overall elevation of the blade 100. As a result, any lengthwise rubber band is lifted to a height where it clears the corners 218. The actuator 108 is then operated to retract the shaft 106 so that the blade swings to a position shown at the left of FIG. 9, the nozzle 80 and blade 90 having been previously raised by the actuators 72, 86. As the blade 100 swings to the left, the rubber band 196 is released from the detent 101 of the blade 100. Depending on the positioning of the rubber band 196 on the bundle 34, it may fall away from the bundle, or be temporarily retained by the girthwise rubber band 194 or pressure pads 50, as illustrated by the broken lines in FIG. 9.

Next, the actuator 108 partially extends the shaft 106 to return the blade 100 to a centered position, whereupon the actuator 96 operates to extend the blade downwardly through the top edge face 212 and into the bundle. The reinsertion of the blade 100 can be assisted by a jet of air from the nozzle 80 and/or use of the spreader blade 90, but such assistance may not be necessary once the bundle is loosened by displacement of the lengthwise rubber band 196.

Once the blade 100 is reinserted, the actuator 60 retracts shafts 64 to move the carriage 58 downstream a distance D to a position where the clamp assembly 48, which comprises friction pads 50, plate 52 and shafts 54, is in the longitudinally displaced position shown by broken lines in FIGS. 1 and 4. When in the displaced position, a leading or downstream portion of the bundle extends beyond the blade 100 and between the friction pads 120, the actuators 128 operate to extend the shafts 130 and cause the friction pads 120 to engage and hold the bundle at a location downstream of the blade 100 and thus downstream of the girthwise rubber band 194. The shaft 54 is then retracted by the actuators 56 so that the bundle is disengaged from the positioning mechanism 21.

The actuators 144 then operate to retract the shaft 146 which pulls the carriage 132 and its associated bundle downstream while the blade 100 remains within the bundle. As the bundle 34 is moved to the position shown in FIG. 11, any rubber bands still retained on the bundle are trapped behind the blade 100 and are thus stripped off the bundle. The rubber bands fall into the chute 114 for collection in a bin (not shown). A blast of air from the nozzle 80 will blow off any rubber bands which may fall onto the belt 30.

When the bundle of envelopes is positioned over the sorting tray 116 as signaled by the sensor 150, actuators 160 operate to extend shafts 162, which lowers the carriage 156, plates 122, friction pads 120 and the bundle 34 held therebetween. The bundle is thus moved to a position, shown by broken lines in FIG. 11, where it is received within the tray 116.

Figure 3:
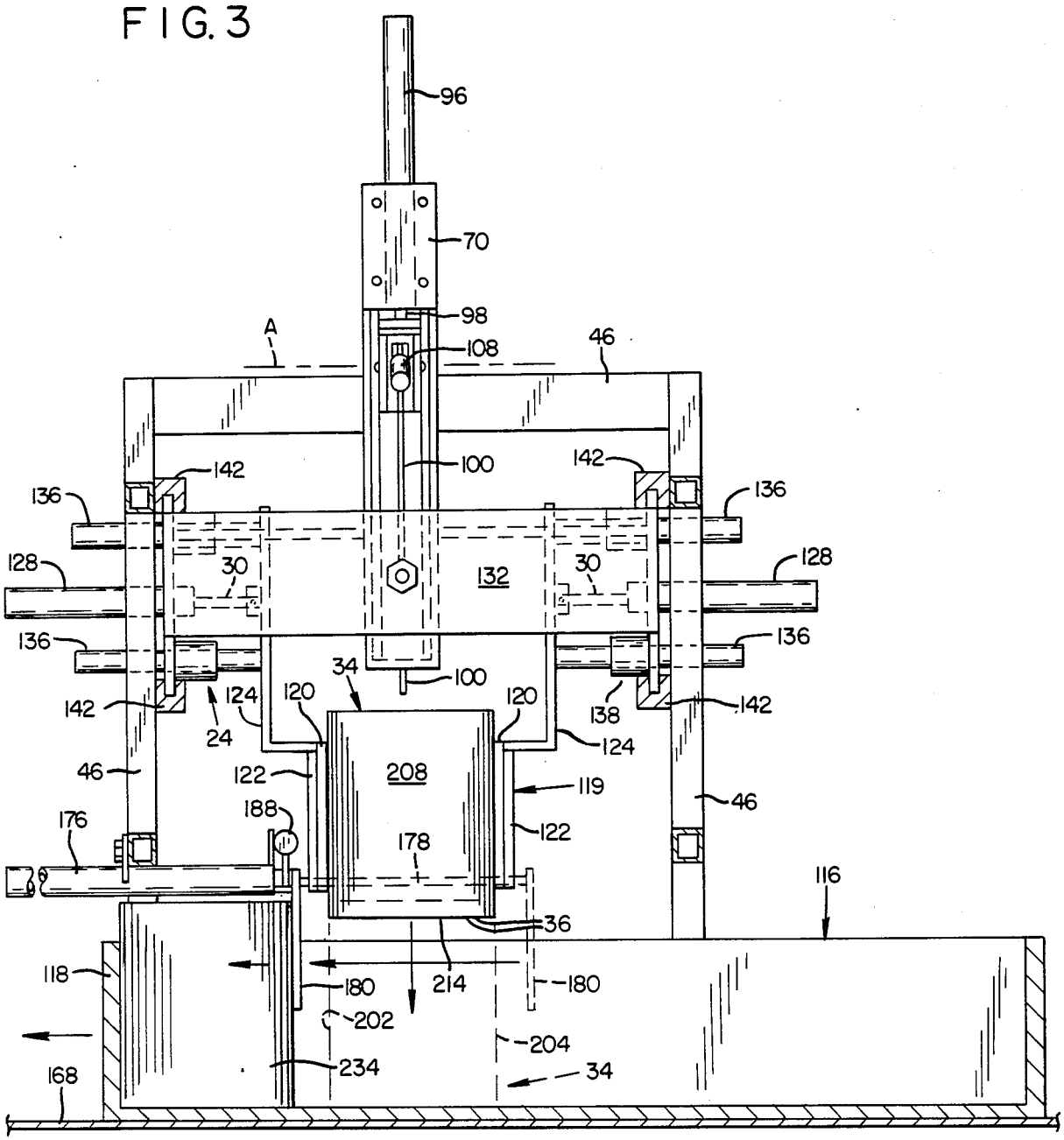
FIG. 3 is a sectional view taken along line 3—3 of FIG. 1.

Next, the actuator 188 operates to retract the shaft 186, causing the support arm 180 to rotate to a horizontal position above the top edge face 212 of the bundle 34. Any previously deposited envelopes 234 are retained in position in the tray 116 by the proximity of one of the plates 122. The actuator 176 then operates to extend the shaft 178 so that the support arm 180 moves across the longitudinal axis of the conveyor belt 30 to a position beyond the rear face 204 of the bundle 34. The actuator 188 is then operated to extend the shaft 186 so that the support arm 180 rotates to the six-o'clock position, as shown by broken lines in FIG. 3. The actuators 128 then operate to retract the shafts 130, thereby disengaging the friction pads 120 from the bundle 34. The actuators 160 operate to retract the shafts 162, which in turn lifts the clamp mechanism 119 comprising the friction pads 120 and support plates 122 from the tray 116. The actuators 144 then operate to extend the shafts 146 to a position such that the clamp mechanism 119 is positioned to receive the next bundle. The extent to which the shaft 146 is extended is determined by the sensor 148, which detects the arrival of carriage 132.

As the transport mechanism 24 is returning to its starting position, the actuator 176 operates to retract the shaft 178 so that the support arm 180 engages the rear face 204 of the bundle 34, which pulls the bundle 34 laterally until the front face 202 of the bundle 34 engages the leading wall 118 of the tray 116 or any previously deposited envelopes 234. As the shaft 178 moves to a fully retracted position, force exerted by the support arm 180 on the rear face 204 of the bundle 34 causes the tray 116 to be moved laterally along the support surface 168 so that the tray 116 will be in position to receive a subsequent bundle. When a tray is substantially full, it will have moved to a position (not shown) at the far left, as viewed in FIG. 3. Sensors (not shown) that detect the tray at the far left position cause the tray 116 to be ejected and a new tray positioned to commence receiving bundles delivered by the transport mechanism 24.

The sequence of operation is then repeated.

Having illustrated and described the principles of the present invention, it should be apparent to those persons skilled in the art that such invention may be modified in arrangement and detail without departing from such principles. For example, many of the operating steps mentioned can, and should, occur simultaneously for best efficiency. And, it will be apparent that the apparatus will work with bundles that omit a lengthwise rubber band or that have multiple spaced girthwise rubber bands. Therefore, the invention shall include all such modifications as come within the true spirit and scope of the following claims.

I claim:

1. An apparatus for nondestructively removing rubber bands that encircle bundles of stacked envelopes, the bundles having front and rear faces and the envelopes having edges which define edge faces, including leading and trailing end faces and top and bottom faces, of the bundles, the apparatus comprising:

transport means for holding a bundle of envelopes secured by a girthwise-girding rubber band;

band-engaging means including a blade movable between extended and retracted positions such that, when a bundle is held by the transport means and the blade is extended, the blade is positioned between two adjacent envelopes of the bundle; and actuator means for causing relative movement between the bundle and the blade in such a manner as to bring the girthwise-girding rubber band into contact with the blade such that the rubber band is nondestructively pulled off the bundle.

2. The apparatus of claim 1 wherein the transport means comprises a clamp mechanism.

3. The apparatus of claim 1 wherein the band-engaging means further comprises spreader means mounted for insertion between two adjacent envelopes of the bundle to maintain a gap between the adjacent envelopes during insertion of the blade, the spreader means comprising:

a spreader blade having parallel faces; and a spreader movement mechanism for maintaining the spreader blade faces generally parallel to the faces of the adjacent envelopes during insertion of the spreader blade between the adjacent envelopes and for rotating the spreader after insertion so that the spreader blade faces are generally perpendicular to the faces of the adjacent envelopes and a gap is maintained between the adjacent envelopes.

4. The apparatus of claim 1 further comprising:

positioning means for positioning the bundle relative to the band-engaging means.

5. The apparatus of claim 4 further comprising:

conveyor means for conducting bundles to the positioning means.

6. The apparatus of claim 5 further comprising:

a platform to support a bundle; and sensor means to detect when a bundle arrives at the platform and to stop the conveyor means when a bundle is detected.

7. The apparatus of claim 4 wherein the band-engaging means further comprises air nozzle means positionable to direct a jet of air toward a side face of a bundle held by the positioning means or by the transport means so as to open a gap between two adjacent envelopes of the bundle.

8. The apparatus of claim 4 for use with a bundle of stacked envelopes secured by a lengthwise-girding rubber band wherein:

the blade is pivotally mounted for movement in a plane parallel to the faces of the envelopes of a bundle held by the positioning means or by the transport means; and actuator means are provided for pivotally moving the blade in such a manner that the blade swings into contact with the lengthwise-girding rubber band and pulls that rubber band off of at least one end face of the bundle.

9. The apparatus of claim 8 wherein the blade member has a detent at its distal end for hooking rubber bands.

10. The apparatus of claim 8 wherein the blade is adapted to move a portion of the lengthwise girding rubber band around a pair of corners of the bundle where two side faces meet the front face and where the two side faces meet the rear face.

11. The apparatus of claim 1 further comprising stacking means for stacking debanded bundles in a storage box.

12. The apparatus of claim 11 wherein the stacking means comprises:

clamp means for engaging front and rear faces of a debanded bundle;

actuator means for moving the clamp means and any associated bundle between a position adjacent the blade and a position over a storage box having a rigid side wall;

actuator means for moving the clamp means and any associated bundle between a position above the box to a position within the box; and a support member for maintaining inserted bundles in front-face-to-rear-face alignment and against the wall of the box.

13. The apparatus of claim 1 comprising chute means located to collect rubber bands after they are removed from a bundle.

14. An apparatus for nondestructively removing rubber bands that encircle bundles of stacked envelopes, the bundles having front and rear faces and the envelopes having edges which define edge faces, including leading and trailing end faces and top and bottom faces, of the bundles, the apparatus comprising:

positioning means for holding a bundle of envelopes secured by a lengthwise-girding rubber band;

band-engaging means including a blade moveable between extended and retracted positions such that, when a bundle is held by the positioning means and the blade is extended, the blade is positioned between two adjacent envelopes of the bundle, the blade being pivotally mounted for pendulum-like movement in a plane parallel to the faces of the envelopes; and actuator means for moving the blade in such a manner that the blade swings into contact with the lengthwise-girding rubber band and pulls the rubber band off of at least one end face of the bundle.

15. The apparatus of claim 14 for use with a bundle of stacked envelopes secured by a girthwise-girding rubber band further comprising:

transport means, downstream of the positioning means, comprising a clamp mechanism for holding the bundle and for stacking bundles into a storage box having a rigid side wall after all rubber bands have been removed;

air nozzle means positionable to direct a jet of air toward a side face of a bundle held by the positioning means or the transport means so as to open a gap between two adjacent envelopes of the bundle;

a spreader blade having parallel faces and being mounted for insertion in the gap between the two adjacent envelopes of the bundle to maintain the gap during insertion of the band-engaging blade;

a spreader movement mechanism for maintaining the spreader blade faces generally parallel to the faces of the adjacent envelopes during insertion of the spreader blade between the adjacent envelopes and for rotating the spreader after insertion so that the spreader blade faces are generally perpendicular to the faces of the adjacent envelopes and a gap is maintained between the adjacent envelopes;

actuator means for causing relative movement between the bundle and the blade in such a manner as to bring the girthwise-girding rubber band into contact with the blade such that that rubber band is nondestructively pulled off the bundle;

a conveyor belt for conducting bundles to the positioning means;

pairs of brushes positioned along the conveyor belt to center and support passing bundles;

a support member for maintaining bundles in front-face to rear-face alignment and against the wall of the storage box after they are inserted by the transport means and for applying pressure to advance the box; and a chute located to collect rubber bands after they are removed from the bundles.

16. The apparatus of claim 15 further comprising:

sensors to confirm that each bundle on the conveyor belt is properly faced, and to signal the position of a bundle along its pathway; and programmed control means, responsive to the sensors, for operating the conveyor belt, positioning means, actuator means, nozzle means, spreader movement mechanism, and transport means.

17. A method for nondestructively removing rubber bands that encircle bundles of stacked envelopes, each bundle being encircled by lengthwise-girding and girthwise-girding rubber bands, the bundles having front and rear faces and the envelopes having edges which define edge faces, including leading and trailing end faces and top and bottom faces of the bundles, the method comprising:

positioning a rubber band-girdled bundle of stacked envelopes at a work station;

inserting an unsharpened blade between two adjacent envelopes of the bundle;

moving the blade relative to the bundle in such a manner that the lengthwise-girding rubber band is removed from at least one end face of the bundle;

reinserting the blade between two envelopes of the bundle;

moving the bundle and blade relative to one another in such a manner that all girthwise-girding rubber bands and any retained lengthwise-girding rubber bands are removed from the bundle; and discharging the bundle from the work station.

18. The method of claim 17 further comprising:

prior to said inserting, compressing the bundle between a first set of clamp pads applied against the front and rear faces near the trailing edge face;

after removal of lengthwise-girding rubber bands, moving the clamp pads downstream to reposition the bundle relative to the blade; and then, prior to reinserting the blade, compressing the bundle between a second set of clamp pads applied against the front and rear faces near the leading edge face and then withdrawing the first set of clamp pads, the moving of the bundle relative to the blade to remove girthwise-girding rubber bands and the discharging of the bundle being subsequently accomplished by moving the second set of clamp pads downstream.

* * * * *